US006748708B1

(12) United States Patent
Fuzier et al.

(10) Patent No.: US 6,748,708 B1
(45) Date of Patent: Jun. 15, 2004

(54) DEVICE FOR ANCHORING STRUCTURAL CABLE

(75) Inventors: Jean-Philippe Fuzier, Orgeval (FR); Jérôme Stubler, Paris (FR)

(73) Assignee: Freyssinet International (STUP) (FR)

( * ) Notice: Subject to any disclaimer, the term of this patent is extended or adjusted under 35 U.S.C. 154(b) by 3 days.

(21) Appl. No.: 10/009,419

(22) PCT Filed: May 30, 2000

(86) PCT No.: PCT/FR00/01479

§ 371 (c)(1),
(2), (4) Date: Mar. 27, 2002

(87) PCT Pub. No.: WO00/75453

PCT Pub. Date: Dec. 14, 2000

(30) Foreign Application Priority Data

Jun. 3, 1999 (FR) ..... 99 07016

(51) Int. Cl.[7] ..... E04C 5/12
(52) U.S. Cl. ..... 52/223.13; 24/122.6
(58) Field of Search ..... 52/223.13; 24/122.6

(56) References Cited

U.S. PATENT DOCUMENTS

| | | | | | |
|---|---|---|---|---|---|
| 4,258,518 | A | * | 3/1981 | Xercavins | 52/223.13 |
| 4,510,723 | A | * | 4/1985 | Soum | 52/223.13 |
| 4,592,181 | A | * | 6/1986 | Matt | 52/223.13 |
| 4,648,146 | A | * | 3/1987 | Nutzel et al. | 14/21 |
| 4,878,327 | A | | 11/1989 | Nutzel et al. | |
| 5,345,742 | A | * | 9/1994 | Rogowsky et al. | 52/698 |
| 5,469,677 | A | * | 11/1995 | Luthi | 52/223.13 |
| 5,493,828 | A | * | 2/1996 | Rogowsky et al. | 52/223.13 |

FOREIGN PATENT DOCUMENTS

| | | | | | |
|---|---|---|---|---|---|
| DE | 2704818 | A | * | 8/1978 | 52/223.13 |
| DE | 3801451 | | | 8/1989 | |
| DE | 29504739 | | | 5/1995 | |
| EP | 0323285 | | | 7/1989 | |
| FR | 2492870 | A | * | 4/1982 | 52/223.13 |
| FR | 2575498 | | | 7/1986 | |
| GB | 948094 | A | * | 1/1964 | 52/223.13 |
| GB | 2 097 835 | | | 11/1982 | |
| GB | 2157339 | | | 10/1985 | |

OTHER PUBLICATIONS

English Translation of European Patent No. 0 323 285, Jan. 2, 1992.

* cited by examiner

*Primary Examiner*—Brian E. Glessner
(74) *Attorney, Agent, or Firm*—Cantor Colburn LLP

(57) ABSTRACT

A device having an anchor block having orifices therethrough, each accommodating a tendon of the cable and a means of immobilizing the tendon. The device further includes a bearing piece for the anchor block, and means of guiding the tendons between the anchor block and a running part of the cable. The guide means are connected to the bearing piece and include an individual guide passage for each tendon of the cable, allowing angular deviation thereof. Each guide passages have, in the direction of the anchor block, a transverse layout aligned with that of the orifices in the anchor block.

14 Claims, 2 Drawing Sheets

DEVICE FOR ANCHORING STRUCTURAL CABLE

FIELD OF THE INVENTION

The present invention relates to the devices used to anchor structural cables used in construction work. It applies in particular to stays, pre-stressing cables and suspension cables of suspension bridges.

DESCRIPTION OF THE RELATED ART

The stays are cables generally designed to transmit tensile loads between two points of a structure to which they are anchored. They are therefore in theory straight, if external effects which tend to curve their path are neglected.

The catenary effect due to the self-weight of the stay, the effect of the wind (external transverse pressure), the slight rotational movements of the building elements supporting the stay anchors, the effects of variations in temperature are factors which lead to angular deflections at the ends of the stays, i.e. where they emerge from the anchor points.

In other cables, significant deflections as they emerge from the anchor point are also possible because of the line they are forced to follow or because of transverse action to which they are subjected.

The construction of anchor points is generally such that only tensile loading is reacted satisfactorily. Local bending moments brought about by the abovementioned angular deflections that may be applied to the anchor point are filtered by means of a continuous or insulated guide at the anchor point exit and located a suitable distance away to ensure that they are sufficiently effective.

The principle of anchoring is based on the individual wedging of each of the tendons of which the cable is made. This entails a certain transverse spacing of the tendons at the anchor block so as to have enough space to fit the individual wedging means which are generally jaws with frustoconical wedges.

In the case of stays, a deflector brings the tendons together into a compact arrangement a certain distance away from the anchor point so as to minimize the overall cross section of the stay in the running part. In general, the guide which filters out the bending moments lies at the deflector which collects the tendons together into a compact formation (see, e.g., EP-A-0 323 285). The relatively long distance between the guide and the anchor block (typically more than one meter) is needed to limit excessive angular deflections of each tendon which would carry the risk of damaging it and would result in additional bending moments at the anchor block. In addition, taking up bending moments too close to the anchor point would leave significant transverse loadings at the anchor block.

GB-A-2 157 339 discloses a stay anchoring device wherein a deflector is mounted in two parts in a tube secured to the anchor block. The part furthest from the anchor block prevents contact between the external strands and the tube, while the part closest to the anchor block prevents the strands from rubbing together when cyclic loadings are applied to the stay. The bending moments, to which the document pays no particular attention, are essentially reacted at the part of the deflector furthest from the anchor block.

In other arrangements, the stay downstream of the anchor block passes through an orifice which widens toward the running part, and which allows the whole of the stay an angular deflection by reacting the bending moments along the length of the zone over which the stay bears against the orifice (see, e.g., GB-A-2 097 835).

SUMMARY OF THE INVENTION

An object of the present invention is to propose an anchoring system which limits the bending stresses of the cable to permissible value as soon as the cable leaves the anchor point. Another object is possibly to make it possible to dispense with an additional external device for reacting the bending moments that are due to the variations in the path of the cable.

The invention thus proposes a device for anchoring a structural cable, comprising an anchor block having orifices therethrough, each accommodating a tendon of the cable and a means of immobilizing said tendon, a bearing piece for the anchor block, and means of guiding the tendons between the anchor block and a running part of the cable, wherein the guide means are connected to the bearing piece and comprise an individual guide passage for each tendon of the cable. Each guide passage widens toward the running part of the cable so as to allow angular deflection of the tendon accommodated in said passage. The guide passages have, in the direction of the anchor block, a transverse layout aligned with that of the orifices in the anchor block.

The overall design of the anchor point is greatly simplified by associating the guide means directly with the anchoring device. The tendons of the cable are individually guided, which means that the inertia of the flexing element is significantly lower than the overall inertia of the cable. This results in effective filtering of the bending moments at the anchor block, even if the distance between the anchor block and the guide means is relatively short. Individual guidance of the tendons avoids the cumulative effect of the transverse loads of the layers of tendons on one another.

Advantageously, each guide passage widens toward the running part of the cable with a radius of curvature that is substantially constant in a plane passing through the axis of said passage.

In a preferred arrangement of the device, the guide means comprise at least one guide member housed in a tube connected to the bearing part, through which the tendon-guiding passages are formed.

The guide member may lie just behind the anchor block, or be spaced a certain distance away from the anchor block. In the latter case, it is possible to make provision for the tendons of the cable to be strands individually protected in the running part, the individual protection of each tendon being interrupted in a chamber lying between the guide member and the anchor block, with sealing means placed between said chamber and the guide member so as to form a sealed separation between the chamber and the running part of the cable, and to contain a filling and protective product injected into the chamber. The device possibly comprises a second guide member lying between the anchor block and the sealing means.

The guide member may be made of a rigid or deformable material. In the latter case, it is advantageous to leave a clearance, in the direction of the running part of the cable, between the circumference of the guide member and the tube in which it is housed, so as to allow the collection of tendons of the cable an angular deflection by deformation of the material of the guide member. The shape of this clearance is optimized so as to provide uniform curvature. When the guide member has a cylindrical periphery, the clearance may result from a widening of the inner face of the tube toward the running part of the cable, with a radius of curvature that is substantially constant in a plane passing through the axis of the tube. When the tube has a cylindrical inner face, the clearance may result from a narrowing of the periphery of the guide member toward the running part of the cable, with a radius of curvature that is substantially constant in a plane passing through the axis of the tube. Another possibility is that the clearance results partly from a narrowing of the periphery of the guide member toward the running part of the cable and partly from a widening of the inner face of the tube toward the running part of the cable.

Advantageously, the deformable guide member has a viscosity, so as to damp the cable when the latter oscillates. This viscosity may be intrinsic to the deformable material of the member and/or may result from a viscous substance contained in cavities formed in this member.

The deformable guide member may comprise, between the guide passages, inserts of an inertia that decreases toward the running part of the cable, which makes it possible to control the curvature experienced by the cable through the member. As an alternative, the tube in which the deformable guide member is housed may have an inertia that decreases toward the running part of the cable.

BRIEF DESCRIPTION OF THE DRAWINGS

Other features and advantages of the present invention will become apparent from the description hereinbelow of non-limiting exemplary embodiments, with reference to the appended drawings, in which.

DESCRIPTION OF PREFERRED EMBODIMENT

Figure 1:
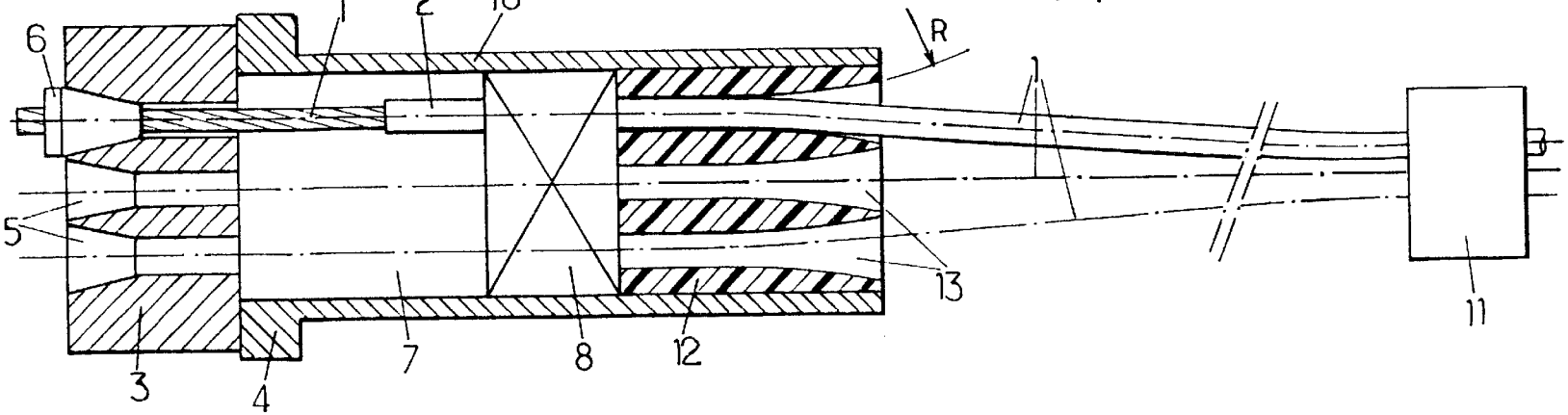
FIGS. 1 to 4 are schematic views in longitudinal section of anchoring devices produced according to the invention.

The invention is described hereinbelow in its application to stays, without this implying any limitation.

The stay anchored by means of one of the devices described hereinbelow by way of example consists of a bundle of strands 1, just one of which is drawn in FIG. 1. In the example considered here, the strands 1 are of the individually protected type: the assembly of stranded metal wires is coated with a product that affords protection against corrosion (for example a grease) and contained in an individual sheath 2 made of plastic (for example a high density polyethylene (HDPE)).

The anchoring device comprises an anchor block 3 applied against a bearing piece 4 along a surface substantially perpendicular to the overall direction of the stay. The bearing piece 4 is pressed, at the opposite end to the anchor block 3, against the structural element to which the stay is connected.

The anchor block 3 has orifices 5 passing through it, which orifices have a frustoconical profile widening toward the opposite face of the block to the bearing piece 4. Each of the orifices 5 accommodates a strand 1 together with a frustoconical jaw 6 which wedges the strand in the orifice.

To reliably anchor the individually protected strand, the individual protection of each strand in the running part is interrupted in a chamber 7 lying behind the anchor block 3. Thus, the jaws 6 grip directly onto the metal wires of the strands. To protect the metal of the strands in the chamber 7 and in the anchor block 3 against corrosion, a filler product (for example a petroleum wax, a grease or a resin) is injected into the chamber 7 and into the gaps left free between the strands and the block 3. To prevent this filler from spreading toward the running part of the stay, the opposite end of the chamber 7 to the anchor block 3 is closed by a sealing device 8 which seals around each sheathed strand 1 and at the inner face of the cylindrical tube 10 which delimits the chamber 7. The sealing device 8 may in particular be of the stuffing box type, as described in application EP-A-0 323 285.

At a certain distance away from the anchoring device, a deflector member 11 collects all of the strands 1 together into a more compact formation than in the anchor point, so as to minimize the overall cross section of the stay in the running part. There is therefore a slight amount of angular convergence of the strands 1 from the anchoring device toward the deflector member 11.

The anchoring device depicted in FIG. 1 comprises a guide member 12 housed inside the aforementioned tube 10. This tube 10 is connected to the bearing piece 4. It may, for example, be as a single piece with this piece 4, as depicted, or with the pieces 4 and 3, or alternatively fixed to an anchor yoke.

In the example of FIG. 1, the guide member 12 consists of a rigid cylindrical block (for example made of HDPE) inserted with practically no clearance into the tube 10. Individual passages 13 are formed in this block 12 to allow each of the strands 1 to pass and to guide them.

On the side facing toward the anchor block 3 (this side lies just behind the rear face of the sealing device 8 in the example depicted), the passages 13 are circular with a diameter corresponding to that of the individually protected strands 1, and their transverse layout is the same as that of the orifices 5 in the anchor block 3.

In the direction of the running part of the stay, each guide passage 13, the overall shape of which has symmetry of revolution, widens in a profile which, in a plane passing through the axis of the passage, has a constant radius of curvature R. This curvature allows angular deflection of the strand toward the deflector member 11 and also allows overall bending movements of the stay. The bending moments are reacted by the guide member 12 along the length of the zone in which the strand 1 is in contact with the wall of its passage.

Figure 2:
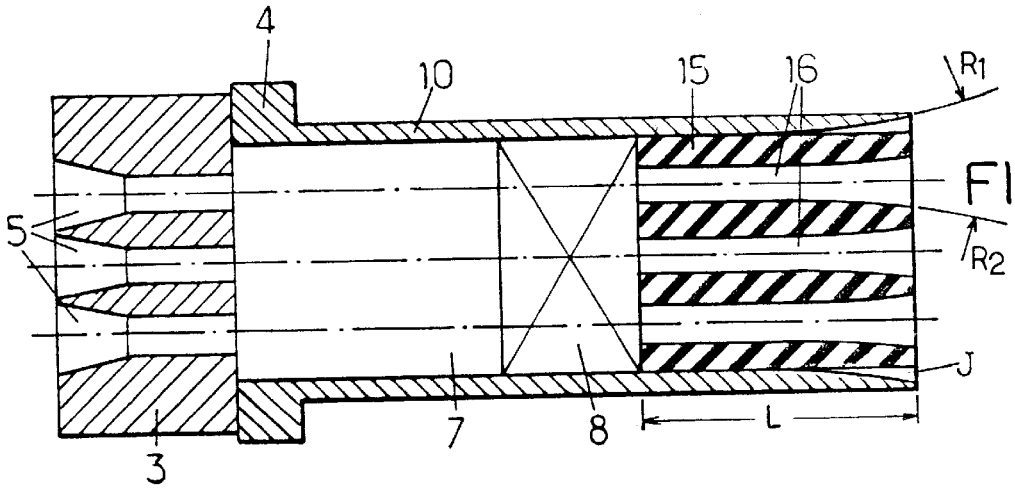
Figure 3:
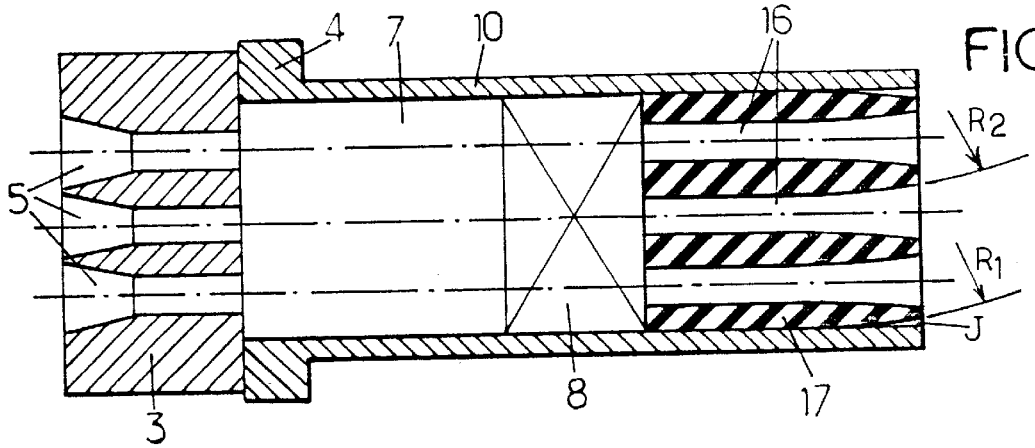

In the devices depicted in FIGS. 2 and 3, the guide member 15, 17 is made of a deformable material such as neoprene. This material may advantageously have viscoelastic properties so as to play a part in damping the vibrations of the cable, the viscosity affording dissipation of the vibrational energy.

The passages 16 formed for the strands in the guide member made of deformable material 15, 17 widen toward the running part of the stay with a radius of curvature $R_2$ which may be greater than the radius R of the embodiment according to FIG. 1. This radius $R_2$ is determined according to the angular deflection due to the convergence of the strands toward the deflector member 11. By way of illustration, this angular deflection may correspond to a tangent of the order of 2%, the radius $R_2$ and the axial length L of the guide member then being chosen so that the half-angle at the mouth of the passage 16 toward the running part of the stay has a tangent slightly greater than 2%.

To tolerate the angular deflections due to the bending movements of the stay and to react the corresponding moments, a clearance J is left between the inner face of the tube 10 and the periphery of the guide member 15, 17 in the direction of the running part of the stay, around the entire circumference of the member 15, 17. Thanks to this clearance J, the material of the member 15, 17 can deform overall, following the bending movements of the stay.

The clearance J is preferably defined by a curvature of constant radius $R_1$ (in a radial plane passing through the axis of the tube 10) at the interface between the periphery of the neoprene guide member and the inner face of the tube 10. This radius $R_1$ is determined, with the length L, as a function of the amplitude of the bending movements to which the stay may be subjected. When the stay is deflected and its tendons are grouped together, these tendons have a maximum radius of curvature defined by a combination of $R_1$ and $R_2$ such that the maximum radius of curvature is less than $R_1$ and the maximum radius of curvature is less than $R_2$. The maximum radius of curvature may be of the same order as the radius R in FIG. 1.

In the example of FIG. 2, the curvature of radius $R_1$ is formed on the inner face, which has symmetry of revolution, of the tube 10 which widens in the direction of the running part of the stay, the periphery of the guide member 15 being cylindrical. In the embodiment depicted in FIG. 3, the curvature of radius $R_1$ is defined on the periphery of revolution of the guide member made of deformable material 17, which narrows toward the running part of the stay, the inner face of the tube 10 being cylindrical.

In another alternative embodiment, which has not been depicted, the clearance J results from a combination of curvatures of the inner face of the tube 10 (FIG. 2) and of the periphery of the member made of deformable material (FIG. 3).

Figure 4:
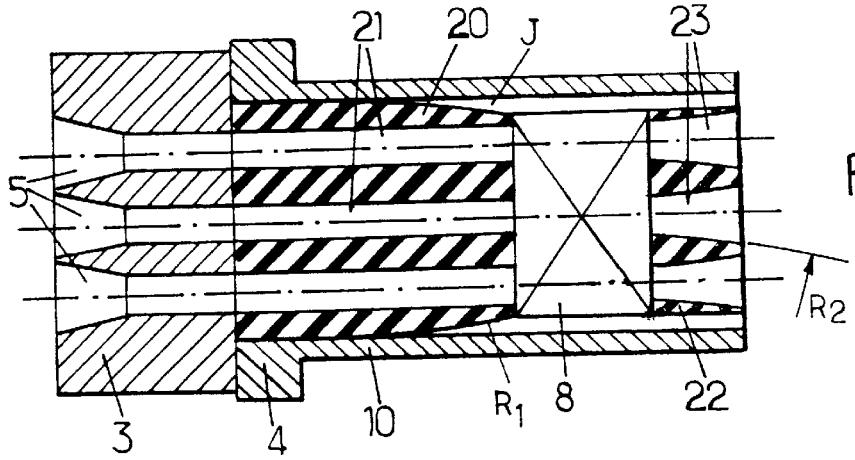

In the example of FIG. 4, the guide means comprise two members made of deformable material, one of them, 20, placed between the anchor block 3 and the sealing device 8, and the other, 22, placed beyond the sealing device 8. Each guide passage accommodating a strand therefore has a cylindrical portion 21, of a diameter that corresponds to that of the strand, formed in the member 20, and a portion 23 formed in the member 22 and which widens toward the running part of the stay with the radius of curvature $R_2$.

The member 20 is housed in the cylindrical tube 10 which keeps it in place on the side of the block 3. Toward the running part, the periphery of the member 20 narrows with the radius of curvature $R_1$ in order to react the bending movements. The member 22, which may be fixed to the sealing device 8, comprises the passage portions 23 which widen with the radius of curvature $R_2$ toward the running part to allow the strands to converge toward the deflector member 11.

In the example depicted in FIG. 4, the clearance J is created like in FIG. 3, by inward curvature of the periphery of the deformable member. Alternatively, the clearance J could be created, completely or partly, by a curvature toward the outside (according to FIG. 2) of the inner face of the tube 10 at the level of the member 20 adjacent to the anchor block.

Figure 5:
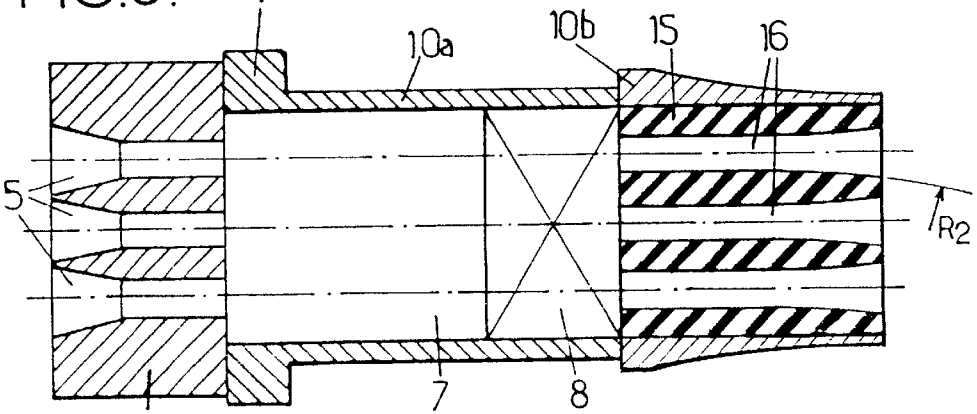
FIG. 5 is a view in longitudinal section of of one embodiment of a guide member.

In the embodiment illustrated by FIG. 5, the tube connected to the bearing piece 4 has two successive portions 10*a* and 10*b*. The portion 10*a*, which is cylindrical, contains the sealing device. The portion 10*b*, which is cantilevered, contains the deformable guide member 15 which may have a similar makeup to the one in FIG. 2. The inertia of this portion 10*b* decreases towards the running part of the stay, which allows the cable and the guide member to bend gradually. The decreasing inertia is achieved by reducing the thickness of the wall of the portion of tube 10*b* (it is also possible to modulate the properties of the material).

Figure 6:
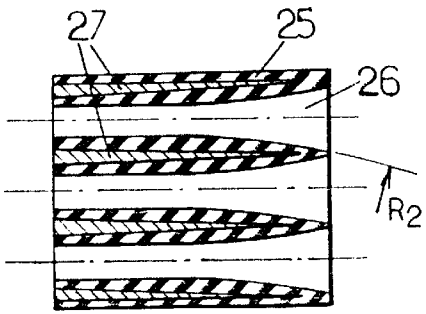
FIG. 6 is a view in longitudinal section of another embodiment of a guide member.

In the alternative embodiment of FIG. 6, the gradual bending of the cable and of the deformable guide member 25 results from the inertia, which decreases towards the running part of the stay, of inserts 27 placed within the deformable material between the guide passages 26. These inserts 27 are, for example, made of metal and of tapering shape. They may be connected to a common support located on the side of the member 25 directed toward the anchor block.

What is claimed is:

1. A device for anchoring a structural cable, comprising:

an anchor block having orifices therethrough, each accommodating a respective tendon of the cable and a means of immobilizing said tendon;

a bearing piece for the anchor block; and guide means for guiding the tendons between the anchor block and a running part of the cable, the guide means being connected to the bearing piece and including an individual guide passage for each tendon of the cable, wherein each guide passage widens toward the running part of the cable so as to allow angular deflection of the tendon accommodated in said passage, and wherein the guide passages have, in the direction of the anchor block, a transverse layout aligned with that of the orifices in the anchor block.

2. The device as claimed in claim 1, wherein each guide passage widens toward the running part of the cable with a radius of curvature substantially constant in a plane passing through an axis of said passage.

3. The device as claimed in claim 1, wherein the guide means comprise at least one first guide member housed in a tube connected to the bearing piece and the guide passages are formed through said first guide member.

4. The device as claimed in claim 3, wherein the first guide member is spaced away from the anchor block.

5. The device as claimed in claim 4, wherein the tendons of the cable are strands having an individual protection member in the running part, wherein the individual protection member of each tendon is interrupted in a chamber lying between the first guide member and the anchor block, wherein sealing means are placed between said chamber and the first guide member so as to form a sealed separation between the chamber and the running part of the cable, and wherein a filler product is injected into the chamber.

6. The device as claimed in claim 5, comprising a second guide member lying between the anchor block and the sealing means.

7. The device as claimed in claim 3, wherein the first guide member is made of a deformable material.

8. The device as claimed in claim 6, wherein the first guide member has a viscosity.

9. The device as claimed in claim 6, wherein the tube in which the first guide member is housed has an inertia that decreases toward the running part of the cable.

10. A device for anchoring a structural cable, comprising:

an anchor block having orifices therethrough, each accommodating a respective tendon of the cable and a means of immobilizing said tendon;

a bearing piece for the anchor block; and guide means for guiding the tendons between the anchor block and a running part of the cable, the guide means being connected to the bearing piece and including an individual guide passage for each tendon of the cable, wherein each guide passage widens toward the running part of the cable so as to allow angular deflection of the tendon accommodated in said passage, and wherein the guide passages have, in the direction of the anchor block, a transverse layout aligned with that of the orifices in the anchor block, wherein the guide means comprise at least one first guide member housed in a tube connected to the bearing piece and the guide passages are formed through said first guide member, wherein the first guide member is made of a deformable material, wherein, in the direction of the running part of the cable, a clearance is left between a circumference of the first guide member and the tube in which said first guide member is housed, so as to allow the collection of tendons of the cable an angular deflection by deformation of the material of the guide member.

11. The device as claimed in claim 10, wherein the first guide member has a cylindrical periphery and the clearance results from a widening of the inner face of the tube toward the running part of the cable, with a radius of curvature substantially constant in a plane passing through an axis of the tube.

12. The device as claimed in claim 10, wherein the tube has a cylindrical inner face, and the clearance results from a narrowing of the periphery of the first guide member toward the running part of the cable, with a radius of curvature substantially constant in a plane passing through an axis of the tube.

13. The device as claimed in claim 10, wherein the clearance results partly from a narrowing of the periphery of the first guide member toward the running part of the cable and partly from a widening of the inner face of the tube toward the running part of the cable.

14. A device for anchoring a structural cable, comprising:

an anchor block having orifices therethrough, each accommodating a respective tendon of the cable and a means of immobilizing said tendon;

a bearing piece for the anchor block; and guide means for guiding the tendons between the anchor block and a running part of the cable, the guide means being connected to the bearing piece and including an individual guide passage for each tendon of the cable, wherein each guide passage widens toward the running part of the cable so as to allow angular deflection of the tendon accommodated in said passage, and wherein the guide passages have, in the direction of the anchor block, a transverse layout aligned with that of the orifices in the anchor block, wherein the guide means comprise at least one first guide member housed in a tube connected to the bearing piece and the guide passages are formed through said first guide member, wherein the first guide member is spaced away from the anchor block, wherein the tendons of the cable are strands having an individual protection member in the running part, wherein the individual protection member of each tendon is interrupted in a chamber lying between the first guide member and the anchor block, wherein sealing means are placed between said chamber and the first guide member so as to form a sealed separation between the chamber and the running part of the cable, and wherein a filler product is injected into the chamber, further comprising a second guide member lying between the anchor block and the sealing means, wherein the first guide member comprises, between the guide passages, inserts of an inertia that decreases toward the running part of the cable.

* * * * *